US008726997B2

(12) United States Patent
Hoffarth

(10) Patent No.: US 8,726,997 B2
(45) Date of Patent: May 20, 2014

(54) METHOD OF COOLING A DOWNHOLE TOOL AND A DOWNHOLE TOOL

(75) Inventor: Clayton Hoffarth, Breton (CA)

(73) Assignee: Raise Production Inc., Calgary, Alberta (CA)

( * ) Notice: Subject to any disclaimer, the term of this patent is extended or adjusted under 35 U.S.C. 154(b) by 0 days.

(21) Appl. No.: 11/400,514

(22) Filed: Apr. 7, 2006

(65) Prior Publication Data

US 2007/0235193 A1 Oct. 11, 2007

(51) Int. Cl.
*E21B 36/00* (2006.01)

(52) U.S. Cl.
USPC ..... 166/302; 175/17

(58) Field of Classification Search
USPC ..... 166/302; 175/17
See application file for complete search history.

(56) References Cited

U.S. PATENT DOCUMENTS 5,539,853 A 7/1996 Jamaluddin
5,845,709 A 12/1998 Mack
6,033,567 A * 3/2000 Lee et al. ..... 166/265
7,188,669 B2 * 3/2007 Bullock et al. ..... 166/105
2006/0191682 A1 * 8/2006 Storm et al. ..... 166/250.01

OTHER PUBLICATIONS

Canadian Examination Report mailed Jul. 5, 2010, issued in corresponding Canadian Application No. 2,501,896, filed Mar. 17, 2005, 2 pages.

* cited by examiner

*Primary Examiner* — Brad Harcourt
(74) *Attorney, Agent, or Firm* — Bennett Jones LLP

(57) ABSTRACT

A method of cooling a downhole tool. A first step involves providing a cooling chamber in the downhole tool. The cooling chamber is positioned in proximity to components to be cooled. A second step involves ports through defining walls of the downhole tool. The ports must be adapted to allow liquids from a well bore, in which the downhole tool is positioned, to communicate with the cooling chamber. A third step involves providing means to circulate liquids from the well bore in through the ports into the cooling chamber and out through the ports back into the well bore, such that the liquids in the cooling chamber are continually being replaced. A heat exchange takes place between the liquids in the cooling chamber and the components to be cooled. The liquids are continually being replaced dissipating heat into the well bore.

12 Claims, 2 Drawing Sheets

METHOD OF COOLING A DOWNHOLE TOOL AND A DOWNHOLE TOOL

FIELD OF THE INVENTION

The present invention relates to a method of cooling a downhole tool, which is used to drill or produce fluids from a well, and a downhole tool, which has been constructed in accordance with the teachings of the method.

BACKGROUND OF THE INVENTION

Heat is generated as a result of the rotary or reciprocating movement of components in a downhole tool. Prolonged exposure to heat has an adverse effect on components, such as seals.

SUMMARY OF THE INVENTION

According to the present invention there is provided a method of cooling a downhole tool. A first step involves providing a cooling chamber in the downhole tool. The cooling chamber is positioned in proximity to components to be cooled. A second step involves ports through defining walls of the downhole tool. The ports must be adapted to allow liquids from a well bore, in which the downhole tool is positioned, to communicate with the cooling chamber. A third step involves providing means to circulate liquids from the well bore in through the ports into the cooling chamber and out through the ports back into the well bore, such that the liquids in the cooling chamber are continually being replaced. A heat exchange takes place between the liquids in the cooling chamber and the components to be cooled. The liquids are continually being replaced dissipating heat into the wellbore.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
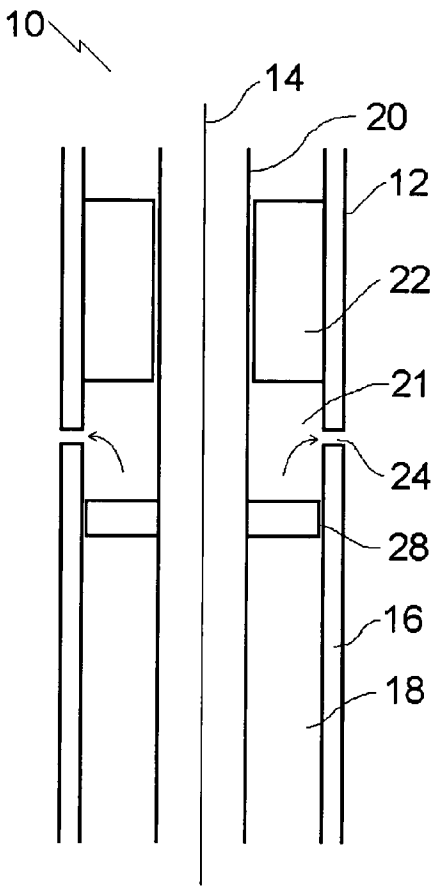
FIG. 1 is a side elevation view, in section, of a portion of a downhole reciprocating pumping apparatus in a retracted position.

Referring to FIGS. 1 through 4, the preferred method of cooling a downhole tool 10 or 100 involves the steps of: providing a cooling chamber 21 in the downhole tool 10 or 100, the cooling chamber 21 being positioned in proximity to components 22 to be cooled; providing ports 24 through defining walls 16 of the downhole tool 10 or 100, the ports 24 being adapted to allow liquids from a well bore, in which the downhole tool 10 or 100 is positioned, to communicate with the cooling chamber 21; and providing means to circulate liquids from the well bore in through the ports into the cooling chamber 21 and out through the ports 24 back into the well bore, such that the liquids in the cooling chamber 21 are continually being replaced. As illustrated in FIG. 1, the means include a piston 28 attached to a reciprocating member 20, in FIG. 3, the means include impeller blades 128 attached to a rotating member 120, and in FIG. 4, the means include a vane 132 resembling an Archimedes Screw attached to rotating member 130.

Figure 2:
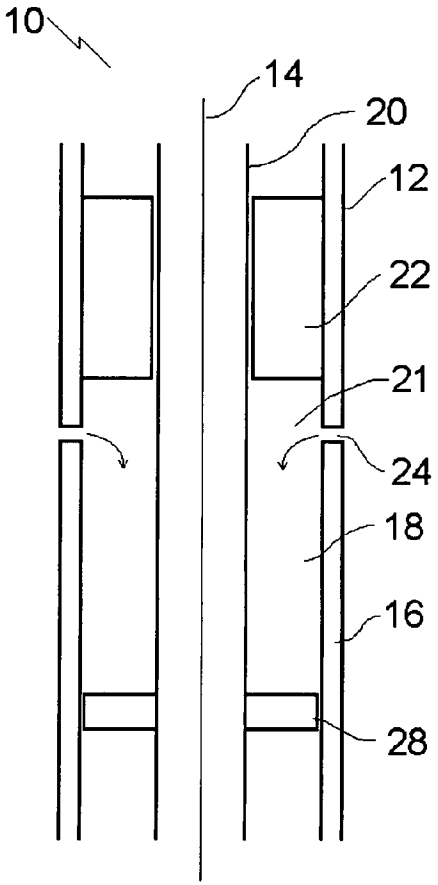
FIG. 2 is a side elevation view, in section, of a portion of a downhole reciprocating pumping apparatus in an extended position.
Figure 4:
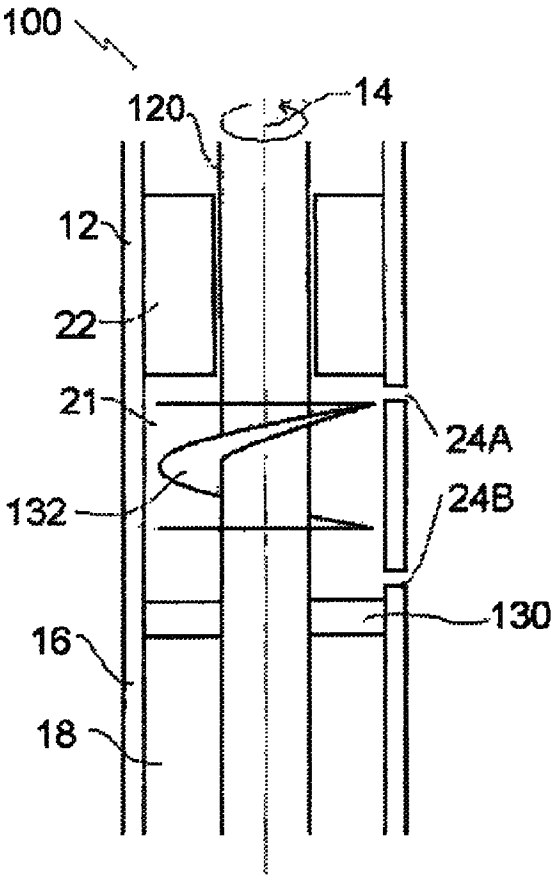
FIG. 4 is a side elevation view, in section, of a portion of a downhole rotary pumping apparatus.
Figure 3:
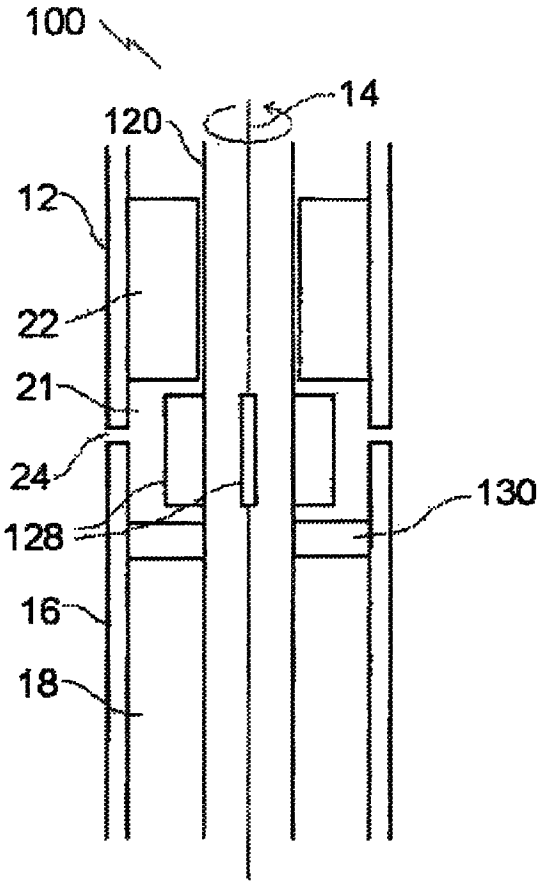
FIG. 3 is a side elevation view, in section, of a portion of a downhole rotary pumping apparatus.

There will now be described how the teachings of this method can be embodied in two different types of downhole tools. A first embodiment will be described with reference to FIGS. 1 and 2. FIGS. 1 and 2 illustrate a side elevation view, in section, of a portion of a downhole reciprocating pumping apparatus. A second embodiment will be described with reference to FIGS. 3 and 4. FIGS. 3 and 4 illustrate a side elevation view, in section, of a portion of a downhole rotary pumping apparatus. As used herein, the term "axial" means a direction substantially parallel to the longitudinal axis of the downhole tool. The terms "lateral" or "transverse" refers to a direction which is at an angle to the longitudinal axis, and is preferably substantially perpendicular to the longitudinal axis.

Structure and Relationship of Parts of the First Embodiment:

Referring now to FIG. 1, there is shown a downhole tool 10 including a tubular housing 12 that has a longitudinal axis 14 and a wall 16 that defines an interior bore 18, with a reciprocating member 20 disposed within interior bore 18 and adapted for reciprocating movement along longitudinal axis 14. Reciprocating member 20 may often be functioning to pump liquids from a well bore. There is a cylindrical cooling chamber 21 in interior bore 18 such that cooling chamber 20 is positioned in proximity to components such as seals 22, as shown, to be cooled. The seal 22 presents a transverse surface that defines one axial boundary of the cooling chamber. Liquids in the cooling chamber are in heat conductive contact with the transverse surface of the seal 22. It will be understood that the present invention may also be used to cool other components. Ports 24 are provided through defining walls 16 that are adapted to allow liquids from the well bore, in which the housing is positioned, to communicate with cooling chamber 21. A piston 28 is attached to reciprocating member 20. Piston 28 draws liquids from the well bore through ports 24 into cooling chamber 21 upon movement in a first direction and expels liquids through ports 24 back into the well bore upon movement in a second direction, such that liquids in cooling chamber 21 are continually being replaced.

Operation of the First Embodiment:

Downhole tool 10 is provided as depicted in FIGS. 1 and 2, with ports 24 thrugh wall 16 of housing 12 that allow liquids to pass from the well bore to the cooling chamber 21 within interior bore 18, and piston 28 attached, either as a separate piece or integrally formed, to reciprocating member 20. As reciprocating member 20 moves from the retracted position shown in FIG. 1 to the extended position shown in FIG. 2, liquid is drawn into cooling chamber 21 from the well bore by piston 28. The liquid will then act to cool components 22. As reciprocating member 20 moves back to the position shown in FIG. 1, piston 28 expels the liquid from cooling chamber 21. A fresh supply of liquid is then able to be drawn into cooling chamber 21 again. In this way, a supply of cooling liquid for cooling components 22 is ensured.

Structure and Relationship of Parts of the Second Embodiment:

Referring now to FIGS. 3 and 4, there is shown second embodiment of downhole tool, indicated by reference numeral 100. Second embodiment 100 also includes tubular housing 12 that has longitudinal axis 14 and a wall 16 that defines interior bore 18. In this embodiment, however, a rotating member 120 is disposed within interior bore 18 and adapted for rotating movement about longitudinal axis 14. Rotating member 120 may often be functioning to pump liquids from the well bore. The wall 16 and the rotating member 120 define the cooling chamber in the lateral direction. The component to be cooled 22, which may be a seal, presents a transverse surface that defines one axial boundary of the cooling chamber 21, and a transverse wall 130 defines another axial boundary of the cooling chamber. Liquids in the cooling chamber are in heat conductive contact with the transverse surface of the component 22. Also, referring to FIG. 3 instead of piston 28, there are impeller blades 128 extending outwardly from rotating member 120. Upon rotation of rotating member 120, impeller blades 128 are adapted to expel liquids in cooling chamber 21 positioned ahead of blades 128 through ports 24 back into the well bore, with liquids from the well bore being drawn through ports 24 into cooling chamber 21 to replace the expelled liquids. Alternatively, referring to FIG. 4, a vane 132 around rotating member 120 in the form of an Archimedes Screw draws fluid in through one port, such as top port 24A, and expels fluid through another port, such as bottom port 24B, or vice versa.

Operation of the Second Embodiment:

Downhole tool 100 is provided as depicted in FIG. 3, with ports 24 through wall 16 of housing 12 that allow liquids to pass from the well bore to the cooling chamber 21 within interior bore 18, and impeller blades 128 attached, either as a separate piece or integrally formed, to rotating member 120. As rotating member 120 rotates about longitudinal axis 14, liquid is expelled and drawn into cooling chamber 21 from the well bore. The liquid is able to cool components 22. Impeller blades 128 expel liquids in cooling chamber 21 positioned ahead of blades 128 through port 24, and then draw liquids into cooling chamber 21 from the well bore. Alternatively, screw vane 132 rotates draws fluid in top port 24A and out bottom port 24B, or vice versa. In this way, a supply of cooling liquid for cooling components 22 is ensured.

Advantages:

The present invention uses the cooling and lubricating properties of liquids from the well bore. The major thrust of the invention is that of cooling, through a circulation of well bore liquids. In some applications, the liquid circulating will be known as a good lubricant, such as oil. In some applications, the liquids circulated will consist mostly of water. Although water is known as a poor lubricant, it is a lubricant nonetheless and will provide some beneficial lubricating effect. Finally, the turbulence created by the flow of fluid in and out of the downhole tool and the resulting turbulence reduces the sedimentary build up around the tool. It will be apparent to one skilled in the art that the teachings of the present invention can be used to cool selected components or provide cooling to the entire tool. A secondary benefit is obtained of creating turbulence around the tool to reduce, if not eliminate, build up of solids between the tool and the well bore. This turbulence helps solids fall past the tool to the cellar of the well bore. This then ensures good contact with and circulation of the well bore fluid around the tool, to maximize heat transfer from the tool to the well bore.

Cautionary Warnings:

The cooling chamber needs a continual circulation of liquids from the well bore. The method and apparatus will not work as intended, if all liquids are vacated from the well bore during operation. This is particularly true during pumping operations, in which the purpose of the downhole tool is to function as a pump to move liquids in the well bore to surface. In such pumping operations, the positioning of the cooling chamber and the ports must be arranged so that the cooling chamber receives the required circulation of liquids.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

What is claimed is:

1. A method of cooling a component in a downhole tool in a well bore, comprising:

providing a cylindrical cooling chamber within the downhole tool, wherein the cooling chamber is defined axially at one end by the component to be cooled, and at the other end by a transverse wall;

wherein an outer wall of the downhole tool defines ports axially between the ends of the cooling chamber that are adapted to allow liquids from the well bore to communicate with the cooling chamber; and circulating liquids from the well bore in through the ports into the cooling chamber, in heat conductive contact with a transverse surface of the component to be cooled, and out through the ports back into the well bore, such that the liquids in the cooling chamber are continually being replaced.

2. The method as defined in claim 1, the downhole tool having a reciprocating member, wherein said circulating liquids from the well bore includes using a piston attached to the reciprocating member, the piston drawing liquids from the well bore through the ports into the cooling chamber upon movement in a first direction and expelling liquids through the ports back into the well bore upon movement in a second direction.

3. The method as defined in claim 1, the downhole tool having a rotating member passing through the cooling chamber, wherein said circulating liquids from the well bore includes using impeller blades extending outwardly from the rotating member within the cooling chamber, and upon rotating of the rotating member, the impeller blades expelling liquids in the cooling chamber positioned ahead of the blades through the ports back into the well bore, with replacement liquids from the well bore being drawn through the ports into the cooling chamber to replace the expelled liquids.

4. The method as defined in claim 1, the downhole tool having a rotating member, wherein said circulating liquids from the well bore includes using a vane resembling an Archimedes Screw extending outwardly from the rotating member, and upon rotating of the rotating member, the vane expelling liquids in the cooling chamber positioned on one side of the vane through the ports back into the well bore, with replacement liquids from the well bore being drawn through the ports into the cooling chamber to replace the expelled liquids on the other side of the vane.

5. The method of claim 1, wherein the circulating fluids are also being produced from the well bore.

6. A downhole tool, comprising:

a tubular housing having an longitudinal axis and a wall that defines an interior bore, with a reciprocating member disposed within the interior bore and adapted for reciprocating movement along the longitudinal axis;

a cylindrical cooling chamber within the interior bore, wherein the cooling chamber is defined axially at one end by a component to be cooled, and at the other end by a transverse wall;

ports through the wall of the tubular housing, wherein the ports are adapted to allow liquids from a well bore in which the tubular housing is positioned to communicate with the cooling chamber; and a piston attached to the reciprocating member, the piston drawing liquids from the well bore through the ports into the cooling chamber upon movement in a first direction, in heat conductive contact with a traverse surface of the component to be cooled, and expelling liquids through the ports back into the well bore upon movement in a second direction, such that liquids in the cooling chamber are continually being replaced.

7. The downhole tool as defined in claim 6, wherein the reciprocating member is functioning to pump liquids from the well bore.

8. A downhole tool, comprising:

a tubular housing having a longitudinal axis and a wall that defines an interior bore, with a rotating member disposed within the interior bore;

a component to be cooled disposed within the interior bore;

a cooling chamber defined laterally by the tubular housing wall and the rotating member, and defined axially by the component to be cooled and a transverse wall, such that liquid in the cooling chamber is in heat conductive contact with a transverse surface of the component to be to be cooled;

ports through the wall of the tubular housing for liquid communication between the cooling chamber and the exterior of the downhole tool; and impeller blades extending outwardly from the rotating member, wherein upon rotation of the rotating member the impeller blades are adapted to expel liquids in the cooling chamber positioned ahead of the blades through the ports back to the exterior of the downhole tool, with liquids from the exterior of the downhole tool being drawn through the ports into the cooling chamber to replace the expelled liquids.

9. The downhole tool as defined in claim 8, wherein the downhole tool is a pump to pump liquids from a well bore.

10. The downhole tool as defined in claim 8, wherein the component to be cooled comprises a seal.

11. A downhole tool, comprising:

a tubular housing having a longitudinal axis and a wall that defines an interior bore, with a rotating member disposed within the interior bore;

a cooling chamber defined laterally by the tubular housing wall and the rotating member, and defined axially by a component to be cooled and a transverse wall, such that liquid in the cooling chamber is in heat conductive contact with a traverse surface of the component to be cooled;

at least two ports through the wall of the tubular housing, for liquid communication between the cooling chamber and an exterior of the downhole tool; and a vane resembling an Archimedes Screw extending outwardly from the rotating member, wherein upon rotation of the rotating member, the vane is adapted to expel liquids in the cooling chamber positioned on one side of the vane through at least one port back to the exterior of the downhole tool, with liquids from the exterior of the downhole tool being drawn through at least one port into the cooling chamber to replace the expelled liquids.

12. The downhole tool as defined in claim 11, wherein the downhole tool is a pump to pump liquids from a well bore.

* * * * *